US008366247B2

(12) United States Patent
Miyakoshi et al.

(10) Patent No.: US 8,366,247 B2
(45) Date of Patent: Feb. 5, 2013

(54) LIQUID EJECTION HEAD

(75) Inventors: Arihito Miyakoshi, Tokyo (JP); Ken Tsuchii, Sagamihara (JP); Hiroshi Arimizu, Kawasaki (JP); Yumi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/694,591

(22) Filed: Jan. 27, 2010

(65) Prior Publication Data

US 2010/0201746 A1 Aug. 12, 2010

(30) Foreign Application Priority Data

Feb. 6, 2009 (JP) ..... 2009-026478

(51) Int. Cl.
*B41J 2/045* (2006.01)

(52) U.S. Cl. ..... 347/68

(58) Field of Classification Search ..... 347/40, 347/43, 68–72
See application file for complete search history.

(56) References Cited

U.S. PATENT DOCUMENTS 7,549,734 B2 6/2009 Imanaka et al.
8,038,264 B2 * 10/2011 Sugahara ..... 347/68

FOREIGN PATENT DOCUMENTS

JP 2006-159893 A 2/2006
JP 2007-168112 A 7/2007

* cited by examiner

*Primary Examiner* — Lamson Nguyen
(74) *Attorney, Agent, or Firm* — Fitzpatrick, Cella, Harper & Scinto

(57) ABSTRACT

A print head is provided by which a temperature change depending on each region in the substrate can be suppressed. The print head has an ink chamber communicating with an ink supply port. Furthermore, the print head has: a plurality of nozzle groups each of which is formed as one unit by combining a plurality of: communication ports that are provided in the ink chamber and that communicate with the ink supply port; pressure chambers including heat generating elements, ink supply ports, and ejection ports. A plurality of nozzle groups are formed in the same substrate and form a plurality of nozzle group arrays that are formed by the nozzle groups and that extend in the same direction. The plurality of nozzle group arrays are formed to be offset from one another in the direction along which the nozzle group array extend.

13 Claims, 14 Drawing Sheets

LIQUID EJECTION HEAD

BACKGROUND OF THE INVENTION

1. Field of the Invention

The present invention relates to a liquid ejection head for ejecting liquid to a printing medium.

2. Description of the Related Art

In recent years, an ink jet printing apparatus has been increasingly in widespread use in which ink is ejected from a print head to cause ink to adhere to the printing medium to thereby form an image for printing. Generally, an ink ejection method in the ink jet printing apparatus includes, for example, a bubble jet method for heating ink to boil the ink to use the foaming force thereof and a piezo method using the displacement of a piezoelectric body when an electric field is applied to the piezoelectric body.

The ink jet printing apparatus is advantageous in that a print head can have a compact size and a high-definition image can be printed at a high speed for example. The ink jet printing apparatus is also advantageous in that multiple color inks can be used to print a color image easily. Recently, ink ejected from the ink jet printing apparatus has an increased ejection frequency. Furthermore, the printing image by the ink jet printing apparatus also has an increased resolution. Thus, there has been a tendency where the electric power inputted to the print head increases. Furthermore, the print head in the ink jet printing apparatus has a reduced size in order to reduce the manufacture cost of the print head. In accordance with this, there has been a tendency where the heat value per a unit area of the print head further increases.

Generally, a change in the ink characteristic is caused in response to a change in the ink temperature. Thus, there may be a case where the characteristic of the ejected ink changes in response to the change in the print head temperature during ink ejection. Regarding this, Japanese Patent Laid-Open Publication No. 2007-168112 discloses an ink jet print head attached with a heat dissipation member having a thermal conductivity in order to dissipate heat to the outside of the print head. As described above, there is an approach to suppress an excessive temperature increase in the print head during printing to thereby stabilize the ink ejection by the print head.

A print head disclosed in Japanese Patent Laid-Open Publication No. 2006-159893 is widely known. The print head having this form is structured so that a plurality of ejection port arrays each of which consists of a plurality of ejection ports are arranged and an ink supply ports extending along the ejection port arrays are formed among the ejection port arrays. Ink is fed from the ink supply ports to flow paths and pressure chambers communicating with the respective ejection ports constituting ejection port arrays at both sides thereof. Then, heaters provided in the pressure chambers are caused to generate heat to thereby eject ink. This configuration is advantageous in that the ejection ports can be arranged at a relatively high density.

The following section will consider a print head having a configuration as disclosed in Japanese Patent Laid-Open Publication No. 2006-159893 in which ink supply ports extend among ejection port arrays along the ejection port arrays and the plurality of ejection port arrays and ink supply ports extend to be parallel to one another. When such a print head is used, heat from those printing elements provided at the centers of the respective ejection port arrays is suppressed from dissipated in the direction along which the ejection port arrays extend. The printing elements at the centers of the respective ejection port arrays have neighboring printing elements in the vicinity of the respective printing elements with regard to the direction along which the ejection port arrays extend. Thus, since the neighboring printing elements also emit heat to have a high temperature, the temperature gradient is suppressed from occurring in the direction along which the ejection port arrays extend.

Furthermore, in the case of the print head having this configuration, the ink supply ports are formed among the ejection port arrays and the plurality of ejection port arrays are formed to be parallel to one another. Thus, there may be a case where an ejection port array both sides of which are sandwiched by ink supply ports is formed. Generally, ink has a thermal conductivity much lower than that of a silicon substrate or an alumina chip plate forming a print head. Heat generated from the printing element is easily transmitted to the silicon substrate and the alumina chip plate. However, heat generated from the printing element is difficult to be transmitted to ink stored in an ink supply port. Due to this reason, in the print head in which ejection port arrays are arranged in the manner as described above, the heat generated from the printing element is difficult to be transmitted to the ink in the ink supply ports formed so as to sandwich the ejection port array. Thus, there may be a case where the ink supply ports may suppress heat from being dissipated in the direction orthogonal to the direction along which the ejection port arrays extend. As described above, the heat generated from the printing elements at the centers of the respective ejection port arrays is difficult to be dissipated. Thus, the centers at the ejection port arrays tend to have an increased temperature.

On the other hand, at the ejection ports formed at ends of the respective ejection port arrays, heat is dissipated to the outside of the ejection port arrays. As described above, a relatively large amount of heat is dissipated from those ejection ports formed at positions close to ends at the outer sides of the ejection port arrays. Thus, the ejection ports formed at positions close to ends at the outer sides of the ejection port arrays have a lower thermal resistance than the ejection ports at the centers of the ejection port arrays. Thus, a temperature increase is suppressed at the positions close to ends at the outer sides of the ejection port arrays. With regard to the direction along which the ejection port arrays extend, the centers of the ejection port arrays have a high thermal resistance and tend to have a temperature increase relatively easily. The outer sides of the ejection port arrays on the other hand have promoted heat dissipation to thereby relatively suppress a temperature increase.

Furthermore, in the print head having the configuration as described above, when the ejection port arrays formed in the print head are compared to one another, the heat dissipation amount from those ejection port arrays formed at the outer side of the substrate among the plurality of ejection port arrays is higher than that from those ejection port arrays formed at the inner side of the substrate. Thus, the ejection port arrays formed at the outer side of the substrate tend to have a suppressed temperature increase. The reason is that, according to the print head having the configuration as described above, an ejection port array formed at the inner side of the substrate is formed so as to be sandwiched between two ink supply ports. As described above, a silicon substrate or an alumina chip plate forming a print head has a thermal conductivity much lower than that of ink. This may cause a case where an ink supply port may hinder heat dissipation in the ejection port arrays formed at the inner side of the substrate. Thus, heat generated from the printing element in the ejection port arrays formed at the inner side of the substrate is dissipated in a relatively small amount. In the ejection port arrays formed at the outer side of the substrate on the other hand, heat is easily dissipated to the outer side of the substrate. Specifically, heat generated from the printing element of the ejection port arrays formed at the outer side of the substrate tends to be dissipated from the printing element in a direction orthogonal to the direction along which the ejection port arrays extend. As described above, among the plurality of ejection port arrays, a relatively high amount of heat is dissipated from the ejection port arrays formed at the outer side of the substrate and thus a temperature increase is suppressed therein. On the other hand, a relatively-small amount of heat is dissipated from the ejection port arrays formed at the inner side of the substrate and thus a temperature increase is easily caused therein.

When the temperature distribution is uneven depending on each region of the print head as described above, ejected ink may have characteristics that are different depending on the respective regions where the ejection ports are formed. Thus, there is a possibility where the respective regions of the print head have an uneven distribution of the ejection performances from the ejection ports, thereby causing an image obtained by printing to have a deteriorated quality.

SUMMARY OF THE INVENTION

In view of the above situation, it is an objective of the present invention to provide a print head by which a temperature change of each region can be more suppressed.

According to an aspect of the present invention, there is provided a liquid ejection head comprising an orifice plate including a ejection port for ejecting liquid to a printing medium, and a substrate including a printing element for generating energy used to eject liquid, a liquid supply port for supplying liquid to the printing element, wherein: the liquid ejection head includes a plurality of nozzle groups each of which is formed as one unit by combining a plurality of: liquid chambers that communicate with the liquid supply port and that are formed between the orifice plate and the substrate; pressure chambers that are formed in the liquid chambers, that have communication ports communicating with the liquid supply port, and that include the printing element; the liquid supply ports; and the ejection ports, the nozzle group includes the pressure chamber arranged therein in a row, the plurality of nozzle groups are arranged in a single substrate along the direction along which the pressure chambers are arranged to thereby form a plurality of nozzle group arrays, in the nozzle group arrays adjacent to one another, the plurality of nozzle groups forming the nozzle group arrays are formed to be offset from one another in the direction along which the pressure chambers are arranged.

According to the present invention, a temperature change of each region can be more suppressed. This can consequently suppress a case where the liquid ejected from a ejection port has a different ejection performance depending on each region. Thus, a print head can be provided by which the quality of an image obtained through printing can be highly maintained.

Further features of the present invention will become apparent from the following description of exemplary embodiments (with reference to the attached drawings).

DESCRIPTION OF THE EMBODIMENTS

The following section will describe embodiments for carrying out the present invention with reference to the attached drawings.

First Embodiment

Figure 1:
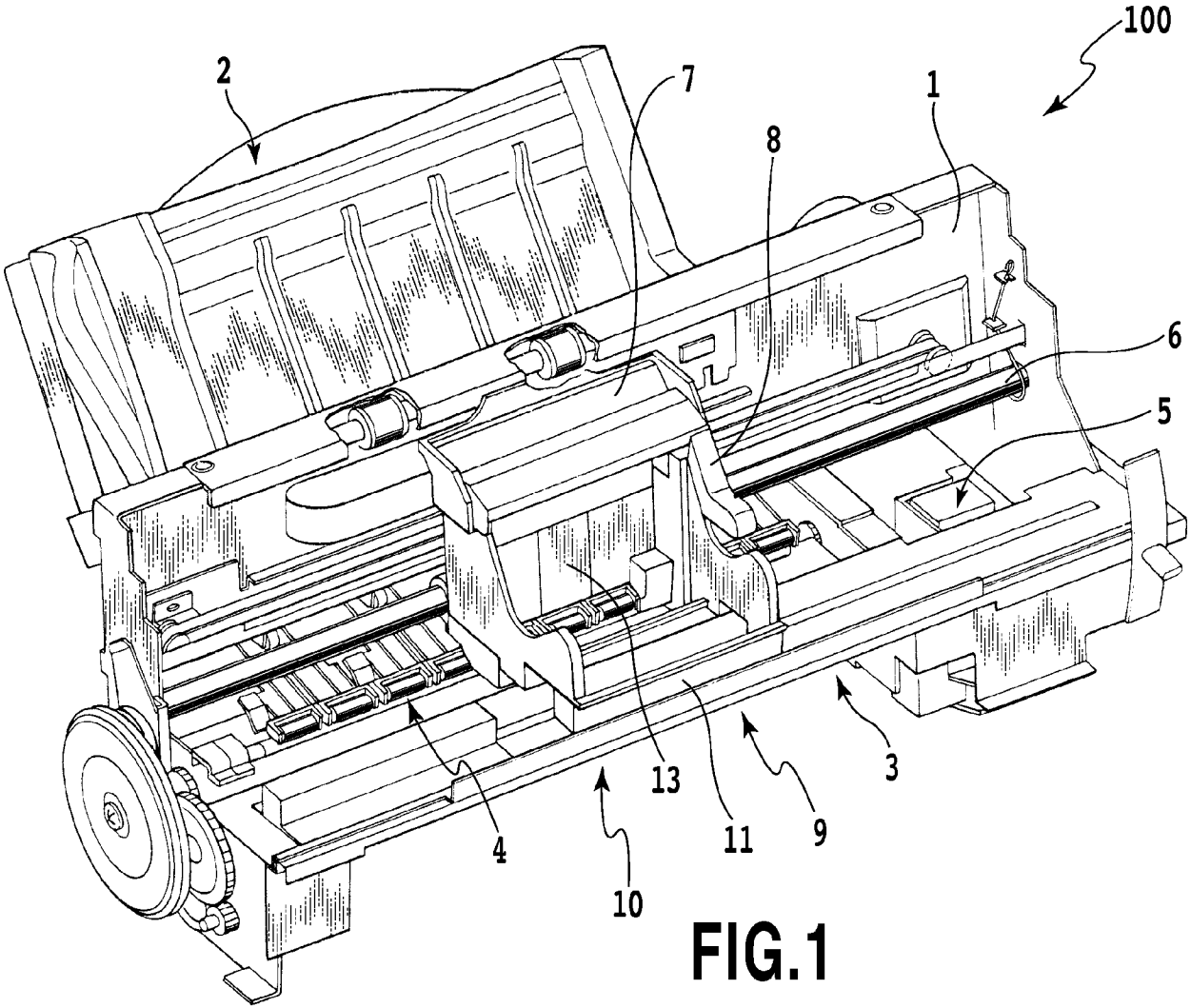
FIG. 1 is a perspective view illustrating the appearance of an ink jet printing apparatus including a print head according to the first embodiment of the present invention.
Figure 2:
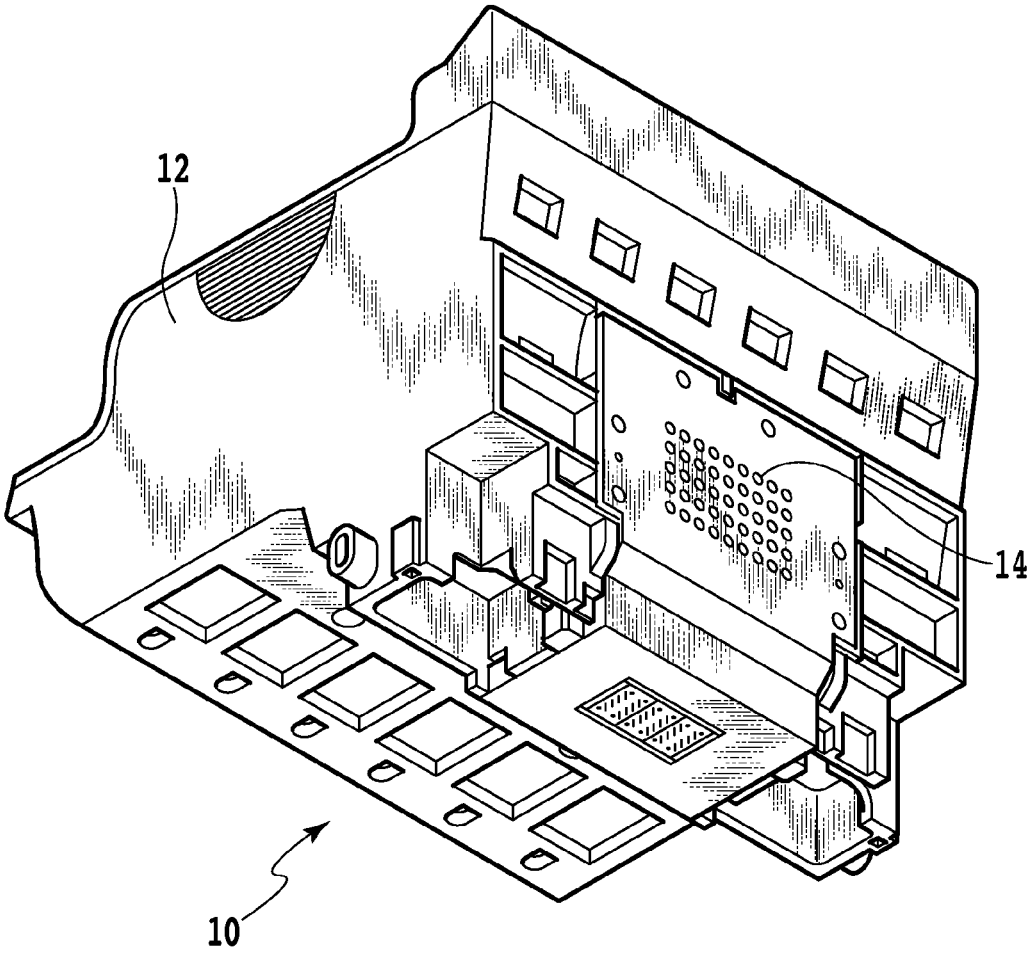
FIG. 2 is a perspective view illustrating the print head mounted in the ink jet printing apparatus of FIG. 1 seen in an obliquely downward direction.
Figure 3:
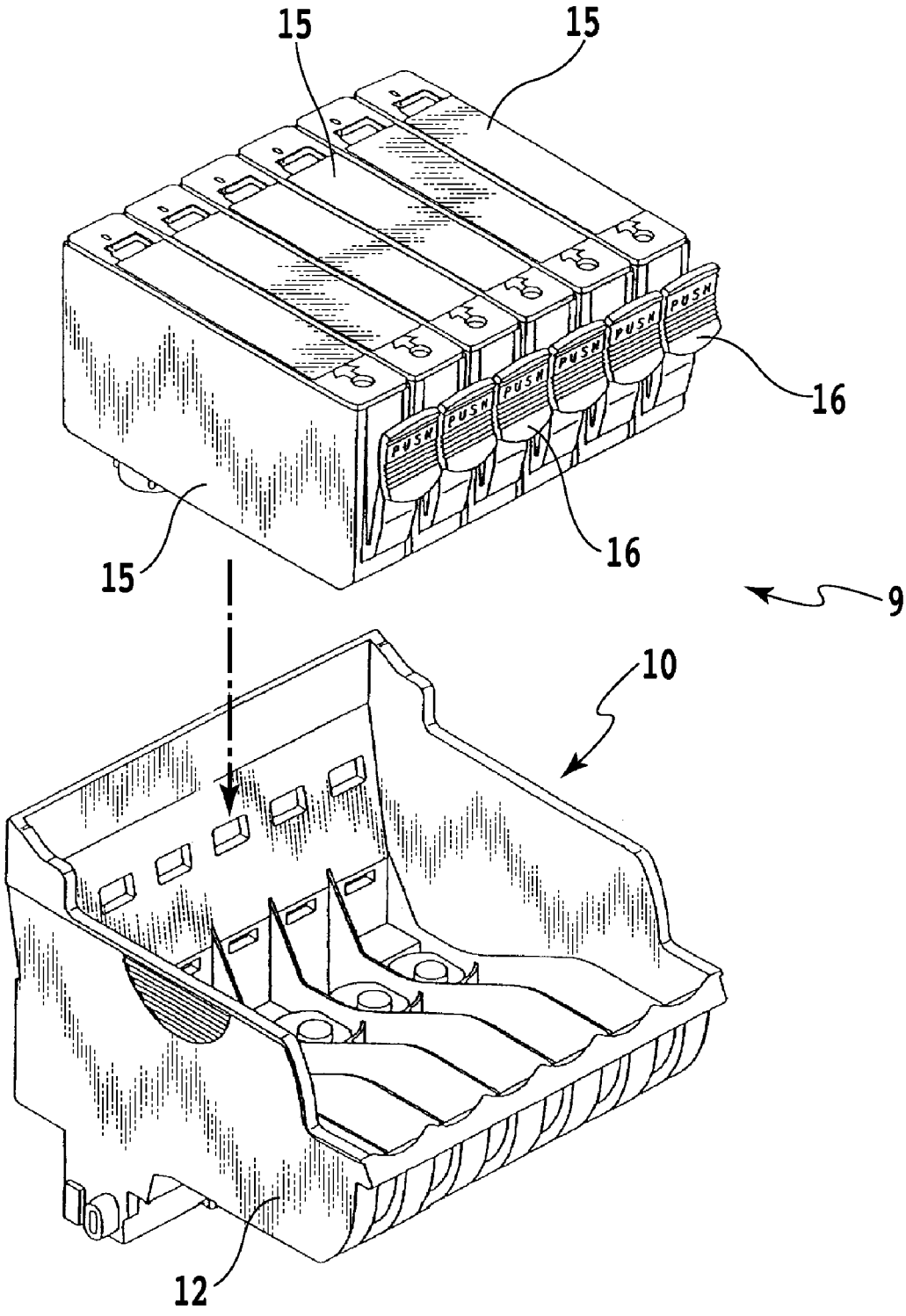
FIG. 3 is a perspective view illustrating the print head of FIG. 2 and an ink tank mounted therein.

The following section will describe an ink jet printing apparatus to which the ink jet print head according to the first embodiment of the present invention can be applied. FIG. 1 illustrates the appearance of a mechanism part of an ink jet printing apparatus 100 in this embodiment. FIG. 2 illustrates the appearance of a head cartridge including a print head 10 as a liquid ejection head mounted in this ink jet printing apparatus 100. FIG. 3 illustrates the appearance of the print head 10 and an ink tank 15 mounted in the print head 10. The chassis 1 of the ink jet printing apparatus in this embodiment is composed of a plurality of plate-like metal members having a predetermined rigidity. The chassis 1 forms the framework of the ink jet printing apparatus. The chassis 1 is attached with a printing medium feeding section 2, a printing medium conveying section 4, a printing section, and a head recovery section 5. The printing medium feeding section 2 automatically feeds a sheet-like printing medium (not shown) to the interior of the ink jet printing apparatus 100. The printing medium conveying section 4 guides printing media fed from the printing medium feeding section 2 one by one to a desired printing position. The printing medium conveying section 4 also guides a printing media from the printing position to a printing medium discharge section 3. The printing section performs a predetermined printing operation on the printing medium conveyed to the printing position. The head recovery section 5 performs a recovery processing to the printing section.

The printing section consists of: a carriage 7 supported so as to be movable for scanning along a carriage axis 6; and a head cartridge 9 detachably provided in this carriage 7 via a head set lever 8.

The carriage 7 in which the head cartridge 9 is mounted includes a carriage cover 11 and the head set lever 8. The carriage cover 11 is attached in order to position the print head 10 of the head cartridge 9 to a predetermined attachment position on the carriage 7. The head set lever 8 is engaged with the tank holder 12 of the print head 10 to press the print head 10 so that the print head 10 is positioned at a predetermined attachment position. The head set lever 8 as an attachment/detachment means is provided so as to be rotatable to a head set lever axis (not shown) at the upper part of the carriage 7. Furthermore, a part at which the print head 10 is engaged with the head set lever 8 has a head set plate (not shown) biased by a spring. In order to attach the print head 10 to the carriage 7, the print head 10 is attached to the carriage 7 while using the spring force by this head set plate to press the print head 10.

Another part at which the print head 10 is engaged with the carriage 7 is connected to one end of a contact flexible printing cable 13 (hereinafter also referred to as contact FPC) A contact section (not shown) formed at one end of the contact FPC 13 and a contact section 14 as an external signal input terminal provided in the print head 10 are configured so as to be able to have an electrical contact. By the contact therebetween, various pieces of information for printing can be sent and received and electric power to the print head 10 can be supplied.

The contact section of the contact FPC 13 and the carriage 7 have therebetween an elastic member (not shown) such as rubber. By the elastic force by this elastic member and the depression force by the head set plate, the contact section of the contact FPC 13 can have a secure contact with the contact section 14 of the print head 10. The other end of the contact FPC 13 is connected to a carriage substrate (not shown) provided at the back face of the carriage 7.

The head cartridge 9 in this embodiment has: the ink tank 15 for storing ink as liquid; and the print head 10 for ejecting the ink supplied from this ink tank 15 through the ejection port depending on the printing information. The print head 10 of this embodiment is applied to the so-called cartridge type so as to be able to attach to and detach from the carriage 7.

Furthermore, in this embodiment, in order to realize a photograph-like color printing having a high image quality, six ink tanks 15 can be used in which the respective color inks of black, light cyan, light magenta, cyan, magenta, and yellow for example are independent. Each of the ink tanks 15 includes an elastically-deformable removal lever 16 that can be engaged to the head cartridge 9. By operating this removal lever 16, the respective ink tanks 15 can be detached from the print head 10 as shown in FIG. 3. Thus, the removal lever 16 functions as a part of an attachment/detachment means. Furthermore, the print head 10 is configured to include an element substrate 17 for example.

Figure 4:
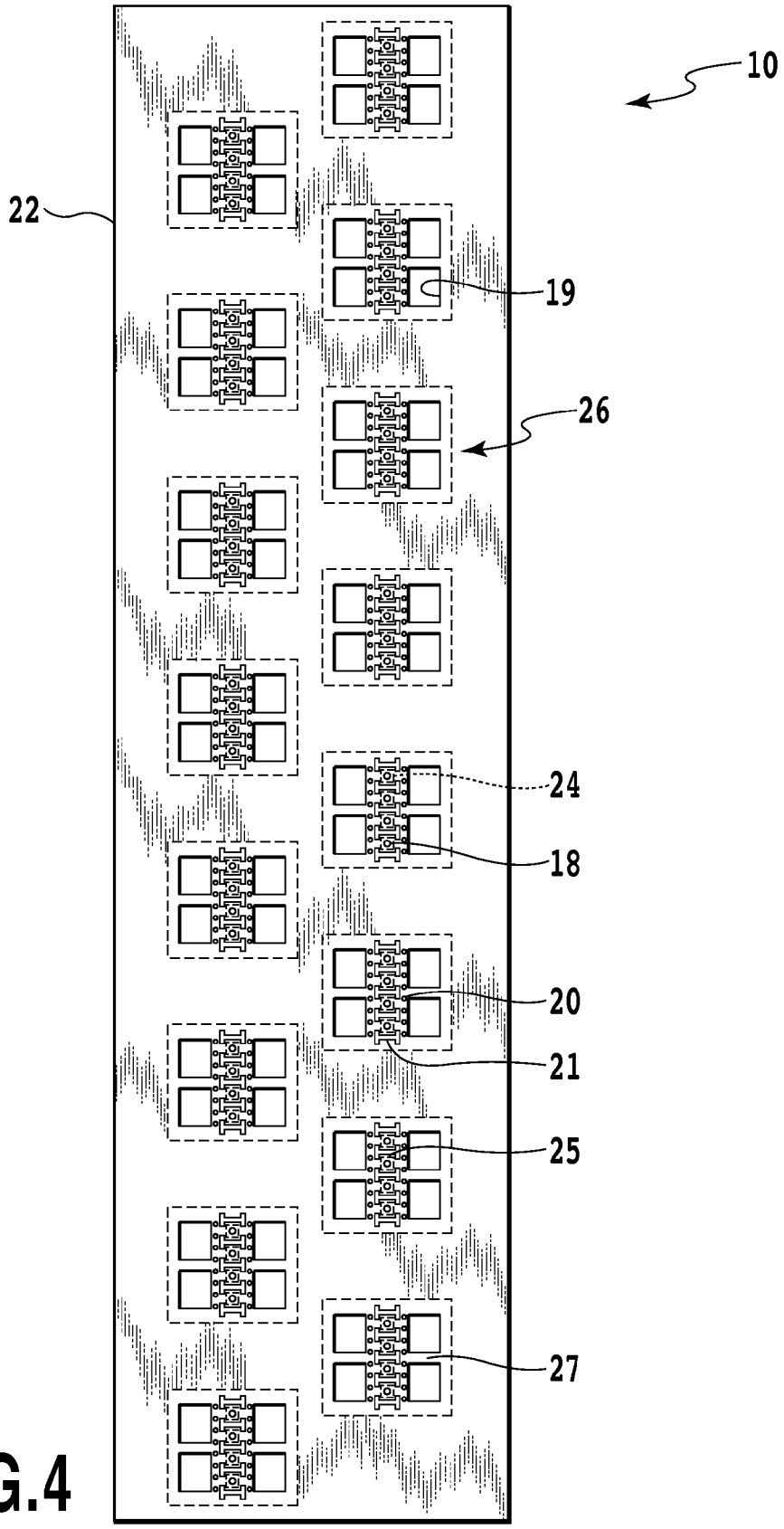
FIG. 4 is an enlarged top view illustrating an element substrate and an orifice plate in the print head of FIG. 2 seen from the printing medium-side.
Figure 5:
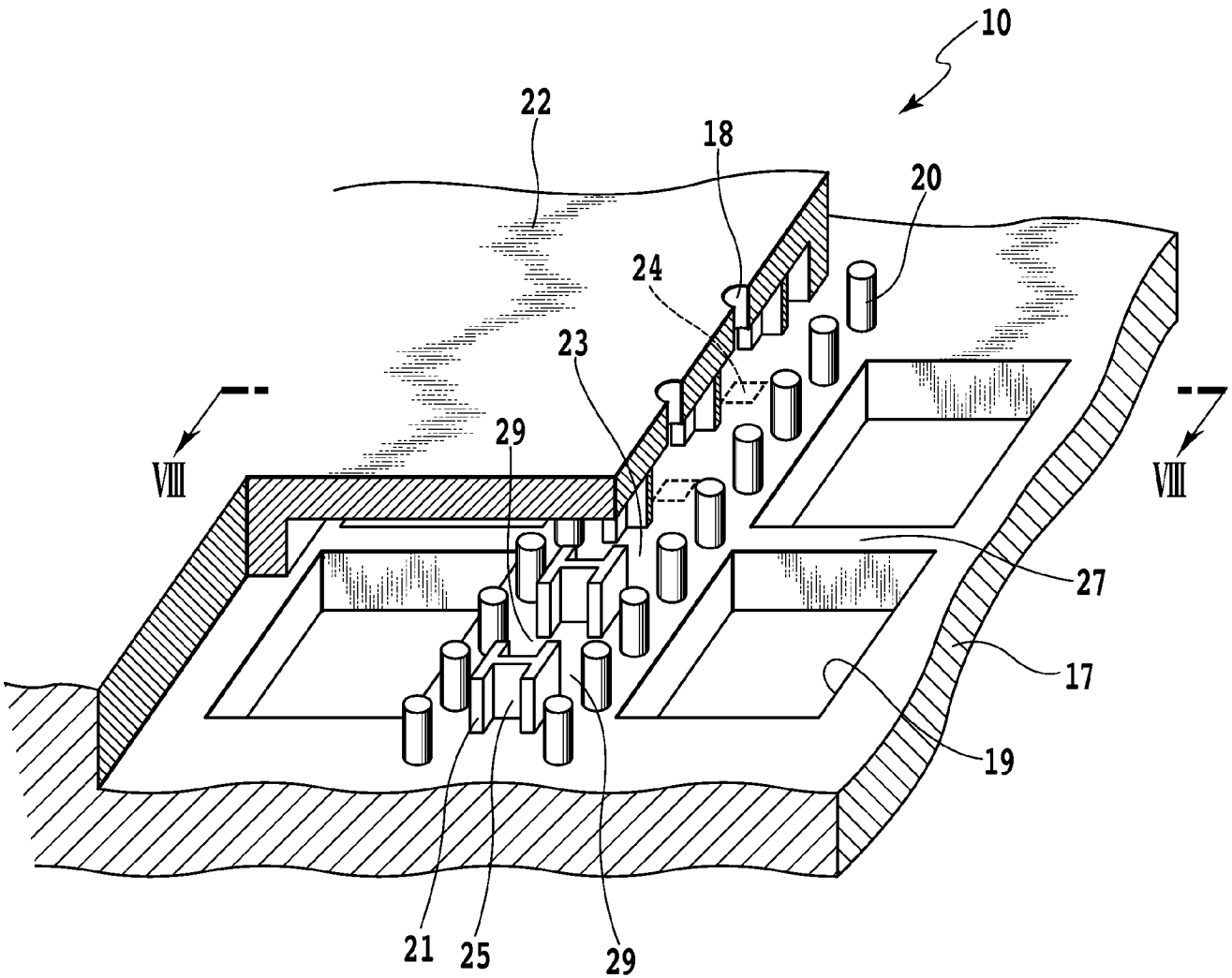
FIG. 5 is an enlarged and partially-exploded perspective view illustrating the main part in the print head of FIG. 4.

Next, the following section will describe the print head 10 of this embodiment. FIG. 4 is a schematic top view illustrating a part of the print head 10 of this embodiment seen from the printing medium-side. When the element substrate 17 in the print head 10 is seen from the printing medium-side, only a ejection port 18 can be seen actually and an ink supply port 19, a column 20, and a nozzle wall 21 cannot be seen. However, they are also shown for description. FIG. 5 is an enlarged and partially-exploded perspective view illustrating the main part in the print head 10 shown in FIG. 4.

As shown in FIG. 5, the print head 10 of this embodiment is formed so that an orifice plate 22 is joined to the element substrate 17. The orifice plate 22 includes a plurality of ejection ports 18 through which ink is ejected to a printing medium. Furthermore, the element substrate 17 as a substrate includes a heat generating element 24 for generating energy used to eject ink. The element substrate 17 includes the ink supply port 19 as a liquid supply port for supplying ink to the heat generating element 24. In a part of the print head 10 shown in FIG. 4 in which a ejection port array is formed, the orifice plate 22 is formed to have a concave shape so that a part of the element substrate 17 side in the orifice plate 22 has a concave shape. As a result, the element substrate 17 and the orifice plate 22 have therebetween an ink chamber 23, thereby forming the print head 10. As described above, the ink chamber 23 communicates with the ink supply port 19 and is formed between the orifice plate and the substrate. Furthermore, a printing element is arranged on the element substrate 17 at a position facing the ink chamber 23 and corresponding to the ejection port 18 in order to generate energy to eject ink through the ejection port 18. In this embodiment, the printing element is an electric heat conversion-type heat generating element 24 that generates heat depending on power distribution.

The element substrate 17 includes, in order to introduce ink to the print head 10, the ink supply port 19 that communicates with the ink liquid chamber 23 so as to penetrate the element substrate 17. The orifice plate 22 includes the ejection port 18 that communicates with the ink chamber 23 and that ejects ink stored in the ink chamber 23 to the outside of the print head. The ink chamber 23 includes, at a position between the element substrate 17 and the orifice plate 22, a plurality of cylindrical columns 20 and nozzle walls 21 for receiving a load. The column 20 is formed in a flow path between the ink supply port 19 and the ejection port 18 to thereby function as a filter. Even when ink supplied from the ink supply port 19 to the ejection port 18 includes dust or the like, the column 20 suppresses the dust or the like from entering a space surrounded by the nozzle wall 21. The column 20 formed between the element substrate 17 and the orifice plate 22 increases the strength of the ink chamber 23 to thereby increase the durability of the print head. In this embodiment, the nozzle wall 21 is formed to have an H-like shape and is provided between the heat generating elements 24 so as to sandwich the heat generating element 24, thereby forming a pressure chamber 25 including the heat generating element 24 between the nozzle walls 21. The pressure chamber 25 communicates with the ink supply port 19 via a communication port 29. In this embodiment, in respective pressure chamber 25, the pressure chamber 25 communicates with the ink supply port 19 via two communication ports 29. As described above, the pressure chamber 25 is formed in the ink chamber 23, has the communication port 29 communicating with the ink supply port 19, and is formed to include the heat generating element 24. The pressure chamber 25 has two communication ports 29 symmetrically formed to sandwich the heat generating element 24. By forming the pressure chamber 25 in the manner as described above, the flow of ink flowing into the pressure chamber 25 is symmetric and the wail face forming the pressure chamber 25 has a symmetric shape.

In order to eject ink, power is firstly distributed to the heat generating element 24 and electric energy is converted to heat to thereby cause the heat generating element 24 to generate heat. As a result, film boiling is caused in ink positioned on the heat generating element 24 in the pressure chamber 25 facing the heat generating element 24 to thereby generate air bubbles. The air bubbles generated in the pressure chamber 25 causes a pressure that pushes the ink in the pressure chamber 25 toward the ejection port 18 positioned above the heat generating element 24 to thereby eject ink through the ejection port 18. The ink ejected from the ejection port 18 reaches a predetermined position on the printing medium.

In the print head 10 of this embodiment, as described above, two ink inlets are formed through which ink is supplied from the ink supply port 19 to the pressure chamber 25 including the heat generating element 24. These ink inlets are formed between the nozzle walls 21 so as to sandwich the heat generating element 24. The pressure chamber 25 has a symmetric shape based on the heat generating element 24. Since the pressure chamber 25 has a symmetric shape based on the heat generating element 24, after ink ejection, ink can be refilled to the pressure chamber 25 such that ink is supplied without causing an uneven ink flow and in a well-balanced manner. As a result, the ink flow to the pressure chamber 25 is symmetric with reference to the heat generating element 24. Thus, during the next ink ejection, air bubbles formed by the driving of the heat generating element 24 are prevented from being unevenly deformed by the ink flow and thus the air bubbles grow in a well-balanced manner. Thus, by the ink ejected in a straight manner through the ejection port, ink can reach with a higher accuracy. Furthermore, since the wall face defining the pressure chamber 25 has a symmetric shape based on the heat generating element 24, the wall face defining the pressure chamber 25 suppresses air bubbles from being unevenly deformed, thus allowing generated air bubbles to grow in a well-balanced manner. Thus, ink can reach with a higher accuracy.

Thus, it is suppressed that deviation of the tail part of liquid droplets ejected by the print head 10 of this embodiment is caused during ink ejection. Thus, by the print head 10, ink can be impacted with a high accuracy. Furthermore, since the ink tail parts can be maintained to be thick and straight, sub droplets other than main droplets in ejected liquid droplets are maintained to have a relatively-large size. Thus, the satellite has an increased size and thus is suppressed from being influenced by air current. As a result, an amount of ink floating as mist is suppressed and dirt on the printing face of the printing medium is suppressed from being caused. This can consequently maintain the quality of the image obtained through printing. Furthermore, floating mist is suppressed from being adhered to the printing apparatus, thus improving the reliability of the printing apparatus.

As shown in FIG. 4, in this embodiment, the print head 10 has a plurality of nozzle groups 26 each of which includes, as a unit, a plurality of the ink chambers 23, the pressure chambers 25, the ink supply ports 19, and the ejection ports 18. In this embodiment, the plurality of nozzle groups 26 formed based on a unit base are formed in the print head 10 and are formed in a single substrate in particular. In this embodiment, four ejection ports 18, four ink supply ports 19, sixteen columns 20, and five nozzle walls 21 constitute a nozzle group 26 as a single unit. The plurality of nozzle groups 26 as units are formed in the print head 10. In this embodiment, the nozzle group 26 includes four ejection ports 18 formed as a single ejection port array. In this embodiment, inks supplied to the same nozzle group 26 are all have the same color.

Figure 6:
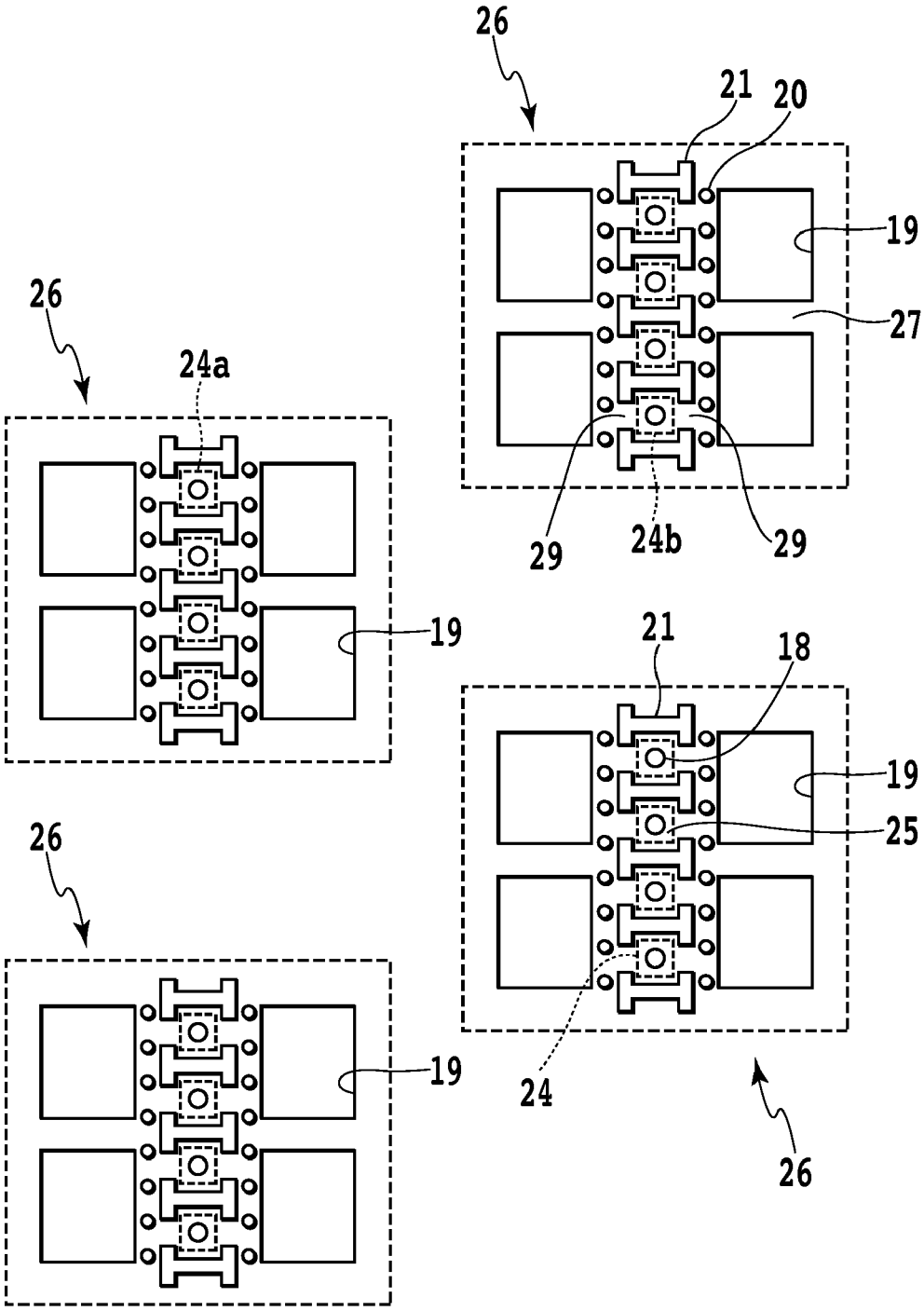
FIG. 6 is an enlarged top view illustrating four nozzle groups in the print head of FIG. 4.
Figure 7:
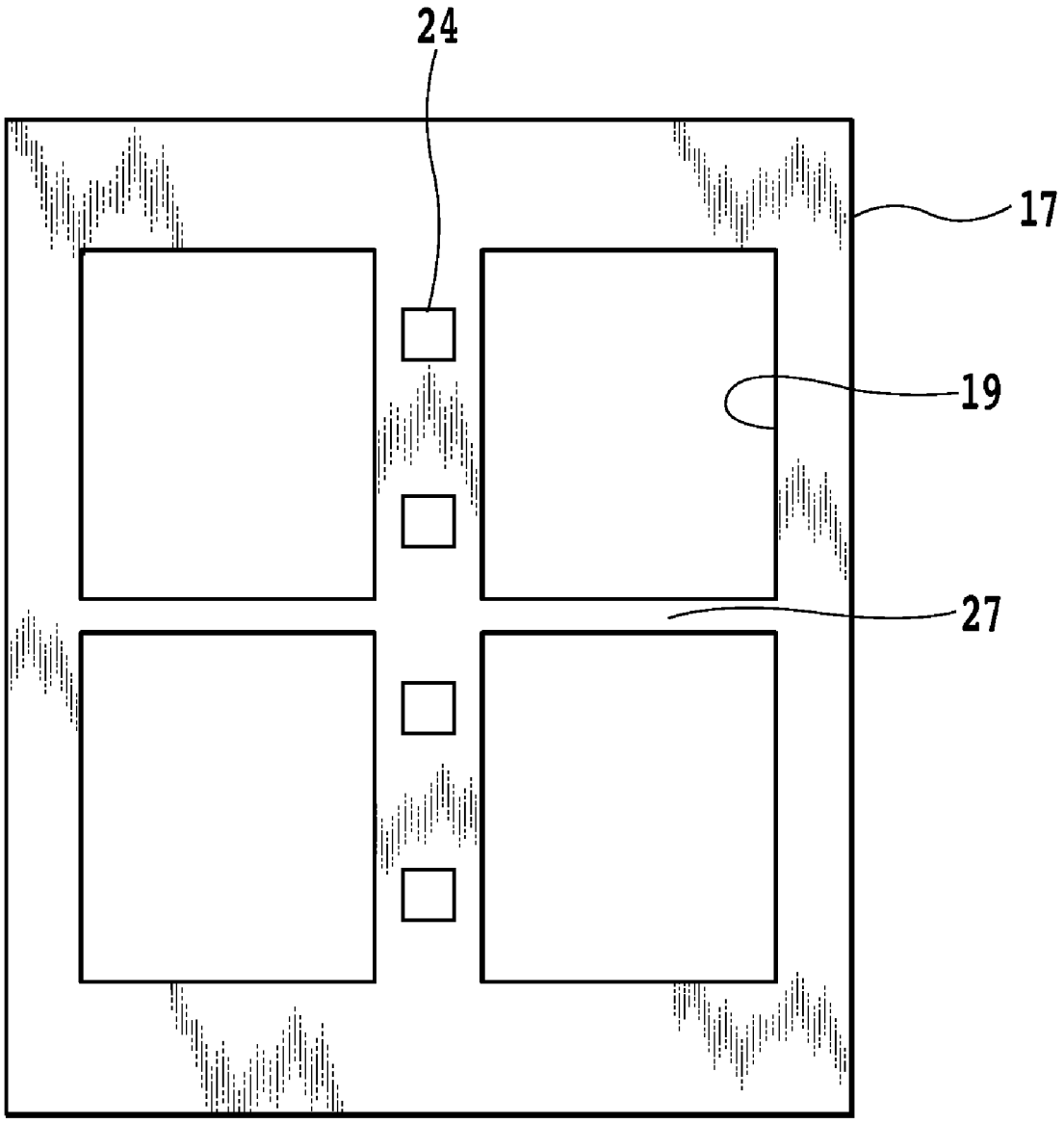
FIG. 7 is a top view illustrating the positional relation between the ink supply ports and heat generating elements in the nozzle groups of FIG. 6.
Figure 8:
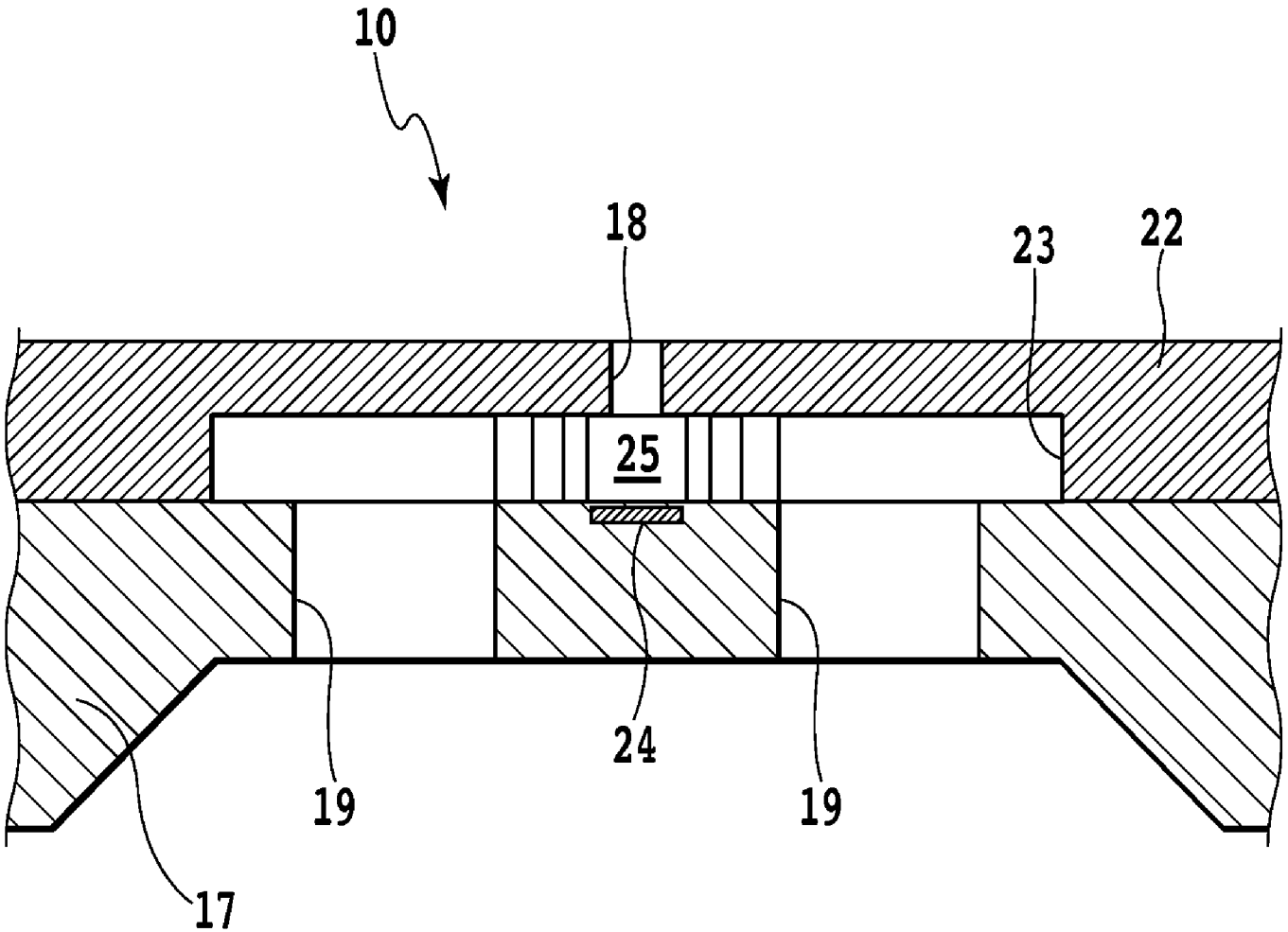
FIG. 8 is a cross-sectional view taken along the line VIII-VIII in the print head of FIG. 5.

The nozzle groups 26 are arranged in a plurality of arrays on the element substrate 17 along the direction in which the pressure chambers 25 are arranged. As a result, the nozzle groups 26 form a plurality of nozzle group arrays extending in the same direction. In this embodiment, two nozzle group arrays are formed in the same element substrate 17. In each array of the nozzle groups 26, the nozzle groups 26 are arranged in the same direction along which the ejection port arrays arranged in the nozzle group 26 extend. As a result, two ejection port arrays are formed on the element substrate 17. The nozzle group 26 of this embodiment has, when the orifice plate 22 and the element substrate 17 are seen from the printing medium-side, the ejection port 18 formed to be sandwiched between the ink supply ports 19. Among the nozzle groups 26 shown in FIG. 4, four nozzle groups are selectively shown in an expanded manner in FIG. 6. FIG. 7 is a top view that selectively shows one nozzle group 26 and that shows the element substrate 17 including the ink supply port 19 and the heat generating element 24 provided on the element substrate 17. FIG. 8 is a cross-sectional view taken along the line VIII-VIII of FIG. 5.

As shown in FIG. 7, in this embodiment, the array in which the heat generating elements 24 are arranged is provided to be sandwiched between the ink supply ports 19 formed in two arrays. Four ink supply ports 19 are formed in one nozzle group 26. In the nozzle group 26, two ink supply ports 19 are allocated to two heat generating elements 24. Two ink supply ports 19 are formed so that an array of two heat generating elements 24 is sandwiched between the ink supply ports 19 at both sides thereof. Since the ink supply ports 19 are separately formed to two heat generating elements 24 to which the ink supply ports 19 are allocated as shown in FIG. 7, a beam 27 is formed between neighboring ink supply ports 19 in the direction along which the array of the heat generating elements 24 extends. The existence of the beam 27 between the ink supply ports 19 as described above secures a heat transfer path to dissipate the heat generated by the driving of the heat generating element 24. This consequently promotes the heat dissipation from the heat generating element 24 close to the center of the nozzle groups 26 at which heat is difficult to dissipate. This can consequently suppress the unevenness of temperature distribution in the direction along which the heat generating element array extends between the heat generating element 24 close to the center and the heat generating element 24 at the outer side at which heat is dissipated relatively easily. This can consequently suppress the uneven temperature distribution in the nozzle group 26.

Furthermore, the existence of the beam 27 formed between the ink supply ports 19 can arrange the wiring for driving the heat generating element 24 for example through the interior of the beam 27. This can consequently reduce the space for the wiring connected to the heat generating element 24 arranged at a position close to the center. This can consequently reduce the size of the print head 10.

In this embodiment, the element substrate 17 is adhered to the orifice plate 22 and a plurality of portions on the orifice plate 22 in side where the element substrate 17 is joined are formed to have a concave shape, thereby forming a plurality of nozzle groups 26 thereamong. As a result, the print head 10 including a plurality of ink chambers 23 is formed. These nozzle groups 26 form nozzle group arrays. The plurality of nozzle group arrays are formed to be offset from one another in the direction along which nozzle group arrays extend. Two nozzle group arrays are arranged in one element substrate 17 so that these nozzle groups are arranged to be offset from one another in a staggered manner in the direction along which the ejection port arrays formed in the nozzle groups extend. Neighboring nozzle groups forming nozzle group arrays are offset (or arranged in a staggered manner) from each other in the direction along which the pressure chambers 25 are arranged.

in this embodiment, the nozzle groups 26 are formed to be offset from one another in the direction along which the ejection port arrays extend. A nozzle group 26 of neighboring nozzle group array among two nozzle group arrays is arranged at a corresponding position between nozzle groups 26 in the direction along which the ejection port arrays extend. Thus, even the nozzle group 26 positioned at the center of the element substrate 17, a path for dissipating the heat generated in the nozzle group 26 to the outer side of the direction orthogonal to the direction along which the nozzle group array extends is secured.

Thus, heat is favorably dissipated even from the nozzle group close to the center of the element substrate 17 in the direction along which the nozzle array extends. This can consequently suppress the temperature increase in the nozzle group at a position close to the center of the element substrate 17. This can consequently suppress the uneven temperature distribution among the respective regions in the element substrate 17. This can consequently suppress the ink characteristics of ejected inks from being different depending on the respective regions of the print head. Since the ink having an even characteristic over the entire print head 10 can be ejected, quality of an image obtained through printing can be maintained to be high.

Conventionally, a print head has been used in which one nozzle array is formed and ink supply ports extends to be parallel to one another in the direction along which the nozzle array extends. In the print head having the configuration as described above, heat from a heat generating element corresponding to an ejection port positioned at the outer side of the nozzle array is dissipated favorably. However, heat from a heat generating element corresponding to an ejection port formed at a position close to the center of the nozzle array is blocked from being dissipated by ink supply ports and thus heat dissipation cannot be achieved sufficiently. This has caused a case where the center and the outer side of the print head have different temperatures.

In contrast with this, in the case of the print head 10 of this embodiment, heat is favorably dissipated to the direction orthogonal to the direction along which the ejection port arrays extend even from the position close to the center of the nozzle group array. This consequently suppresses an uneven temperature distribution among the respective regions in the print head 10. Furthermore, the increased heat transfer paths for heat dissipation can increase the amount of heat dissipated from the print head 10, thus suppressing the temperature increase in the print head 10.

Furthermore, in this embodiment, for the purpose of improving the accuracy of impact position of ink, the flow of ink flowing in the pressure chamber 25 is caused to be symmetric. In order to allow the wall face defining the pressure chamber 25 to have a symmetric shape, the array of the heat generating elements 24 is arranged to be sandwiched between the ink supply ports 19. Furthermore, since ink has a much lower thermal conductivity than that of a silicon substrate or an alumina chip plate forming the print head 10, the heat dissipation amount through the ink supply port 19 is much lower than the heat dissipation amount through the element substrate 17. Thus, when considering only one nozzle group 26, the heat generated from the heat generating element 24 is difficult to be dissipated. However, since this embodiment provides a plurality of nozzle group arrays formed to be offset from one another in the direction along which the nozzle group arrays extend, the heat amount dissipated from the nozzle groups can be secured sufficiently. This can consequently suppress an excessive temperature increase of the print head 10. In particular, an excessive temperature increase in the nozzle group can be suppressed at a position close to the center in the print head 10 in the direction along which the ejection port arrays extend.

A distance between a heat generating element formed at an end of a certain nozzle group 26 (the heat generating element 24*a* of FIG. 6) and a heat generating element formed at an end of the neighboring side of a neighboring nozzle group 26 (the heat generating element 24*b* of FIG. 6) in the direction along which the heat generating element array extend is equal to a distance between the heat generating elements 24 arranged in the same nozzle group 26 in the direction along which the heat generating element array extend. Thus, the heat dissipation amount can be improved without lowering the density of the heat generating elements 24 in the direction along which the heat generating element array extend. As described above, the respective regions of the print head 10 can have an even temperature distribution. Thus, the dispersion of the ink characteristics of inks ejected from the respective ejection ports can be suppressed without lowering the resolution of the printing image. Thus, the quality of the printing image can be maintained to be high.

In this embodiment, ink that is supplied to the same nozzle group and that is ejected from the same nozzle group is assumed to have the same color. However, the present invention is not limited to this. Inks of different colors also may be ejected through the respective nozzle arrays or inks of different colors also may be ejected through the respective ejection ports.

Second Embodiment

Next, with reference to FIGS. 9, 10, the second embodiment will be described. In the figures, the same components as those of the first embodiment are denoted with the similar reference numerals and will not be described further and only different parts will be described.

Figure 9:
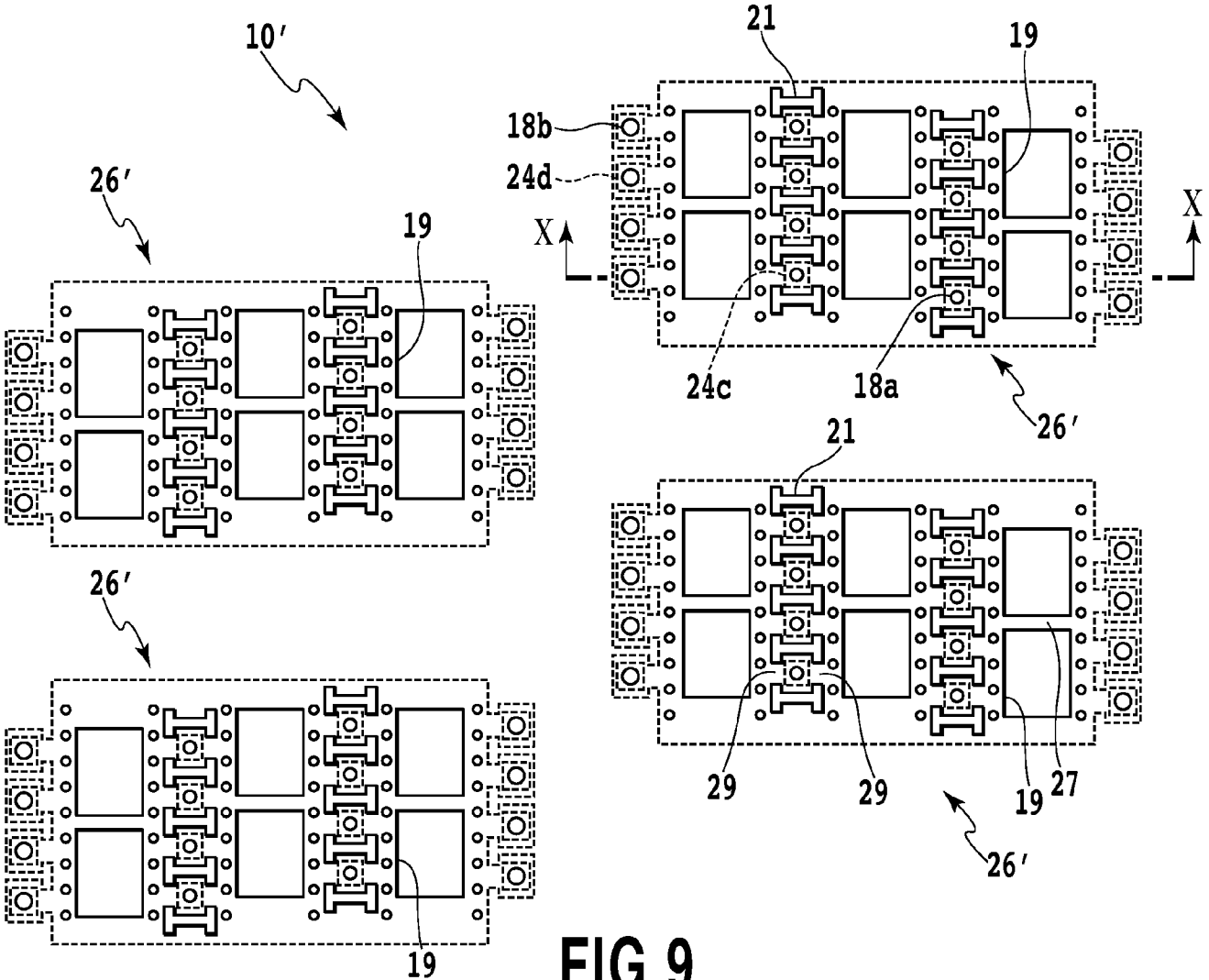
FIG. 9 is an enlarged top view illustrating four nozzle groups of a print head according to the second embodiment of the present invention.
Figure 10:
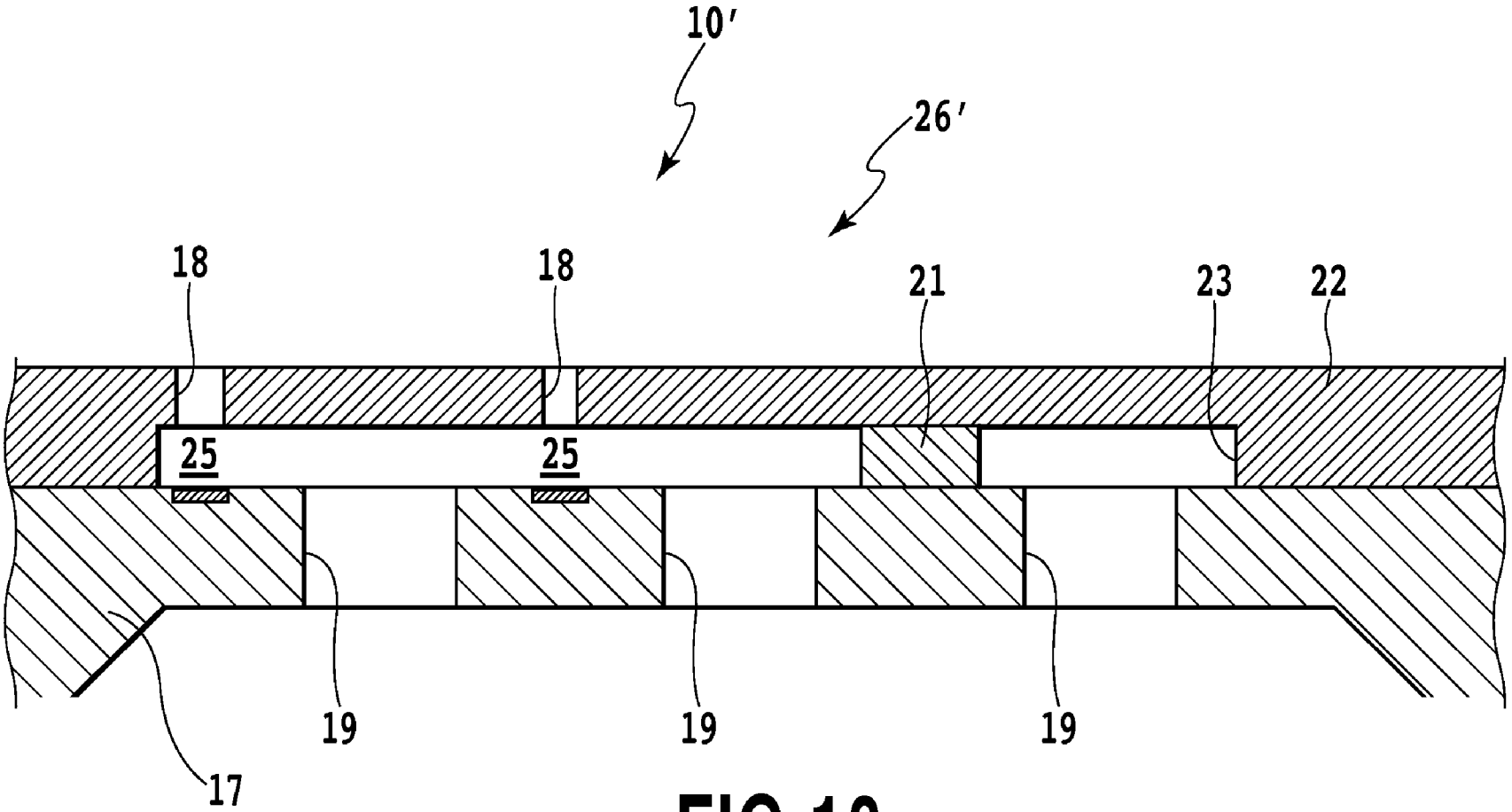
FIG. 10 is a cross-sectional view taken along the line x-x in the print head of FIG. 9.

FIG. 9 is a top view illustrating the main part of the print head of the second embodiment. FIG. 10 is a cross-sectional view taken along the line X-X in FIG. 9.

In the print head of the first embodiment, one unit of nozzle group 26 includes one ejection port array and one array of the heat generating elements 24 corresponding to the ejection port array. At both sides of the ejection port array, the ink supply ports 19 are formed so as to sandwich the ejection port array. The ink supply port 19 is divided to four parts so that the beams 27 are formed in spaces between the ink supply port 19 in the direction along which the ejection port arrays extend. Furthermore, the pressure chambers 25 are formed among the ink supply ports 19 in a direction orthogonal to the direction along which the ejection port arrays extend. The pressure chamber 25 receives ink supplied from both of the ink supply ports 19 formed at both sides thereof. These nozzle groups 26 are offset from one another in the direction along which the ejection port arrays extend.

On the other hand, in the print head 10' of the second embodiment, two ejection port arrays are arranged at a position close to the center of one unit of nozzle group 26' and two arrays of the heat generating elements 29 are arranged at positions corresponding to the ejection ports 18 of the ejection port arrays. Furthermore, the ink supply ports 19 are formed between the two ejection port arrays and at both sides of the ejection port arrays in a direction orthogonal to the direction along which the ejection port arrays extend. In this embodiment, one unit of nozzle group 26' includes three arrays of the ink supply ports 19. These ink supply ports 19 are divided to two parts in the direction along which the ejection port arrays extend. One unit of nozzle group 26' includes the total of six ink supply ports 19. The beam 27 is formed between the ink supply ports 19 in the direction along which the ejection port arrays extend.

At each of both of the outer sides of a direction orthogonal to the direction along which the ejection port arrays extend in one unit of nozzle group 26', one ejection port arrays is further formed. The pressure chamber corresponding to the ejection port 18*b* constituting this ejection port array formed at the outer side communicates with the ink chamber 23 only at one position. Ink is supplied from the ink supply port 19 via this communicating ink flow path only in one direction. As described above, the nozzle group 26' in this embodiment has the ejection port 18*b* facing the ink supply port 19 only in one direction when the orifice plate 22 and the element substrate 17 are seen from the printing medium-side. In the nozzle group 26' of this embodiment, the plurality of ejection ports 18*a* each of which is formed to be sandwiched between the ink supply port 19 and the plurality of ejection ports 18*b* facing the ink supply ports 19 only in one direction are arranged in the nozzle group 26 to form ejection port arrays, respectively.

The two ejection port arrays formed at the position close to the center of the nozzle group 26' are formed to be offset from one another in the direction along which the ejection port arrays extend, respectively. Among the ejection port arrays formed in the nozzle group 26', ejection port arrays which are formed at the outer sides and through which ink from the ink supply port 19 is supplied only from one portion are aligned to the ejection ports constituting the neighboring inner ejection port array and are formed without being offset. Thus, when the ejection ports formed at both outer sides are compared, they are formed to be offset from each other in the direction along which the ejection port arrays extend. As described above, the ejection port arrays are formed to be offset in the nozzle group 26' and thus the ejection port arrays positioned at a position close to the center of the nozzle group 26' are formed in a staggered manner.

Furthermore, in the print head 10' of this embodiment, an interval between the ejection ports in the ejection port arrays formed at a position close to the center of the nozzle group 26' in the direction along which the ejection port arrays extend is equal to an interval between ejection ports in the ejection port arrays formed at the outer side of the nozzle group 26' in the direction along which the ejection port arrays extend. As described above, in this embodiment, an interval between ejection ports in the ejection port arrays formed by the ejection ports formed to be sandwiched between the ink supply ports 19 in the direction along which the ejection port arrays extend is equal to an interval between the ejection ports in the ejection port array formed by ejection ports facing the ink supply ports 19 only in one direction in the direction along which the ejection port arrays extend.

Furthermore, in this embodiment, the ejection port 18*a* where both sides are sandwiched between ink supply ports and which are formed at a position close to the center of the nozzle group 26' ejects a relatively small amount of ink. The ejection port 18*b* only one side of which faces the ink supply ports and which is formed at the outer side of the nozzle group 26' ejects a relatively large amount of ink. Since the ejection port 18*b* which is formed at the outer side of the nozzle group 26' and which faces the ink supply ports only at one side ejects a relatively large amount of ink, the heat generating element 24*d* used for the ejection port 18*b* has a relatively high heat value. Thus, a case may be considered where a temperature increase causes at this portion. Thus, there is possibility that an unevenness of temperature distribution in the print head causes. However, since the heat generating element 24*d* arranged at the outer side of the nozzle group 26' has more heat transfer paths for heat dissipation than the heat generating element 24*c* arranged at a position close to the center, the heat generating element 24*d* has a large amount of heat dissipation. This consequently suppresses the temperature increase in this part. As described above, in this embodiment, the heat generating element 24*d* having a relatively high heat value is arranged at the outer side of the nozzle group 26' and the heat generating element 24*c* having a relatively low heat value is arranged at a position close to the center. This arrangement can provide a balanced heat amount distribution in the nozzle group 26' to thereby maintain the temperature in the print head 10' evenly. As described above, the nozzle group 26' of this embodiment is structured so that the ejection port 18*b* facing the ink supply port 19 only in one direction ejects a larger amount of ink than that ejected from the ejection port 18*a* formed to be sandwiched between the ink supply ports 19.

Furthermore, in this embodiment, each of the nozzle groups 26' is formed so that the respective ejection port arrays are formed by ejection port having the same ink ejection amount so that a plurality of ejection ports for ejecting the same ejection amount of liquid are arranged in arrays to eject the same ejection amount of ink. When the nozzle group arrays are formed by the nozzle groups 26', in a single nozzle group array, ejection port arrays are formed by ejection ports arranged in different nozzle groups having the same ejection amount and aligned to one another to thereby form ejection port array. As shown in FIG. 9, the ejection port array that is formed at a position close to the center in one nozzle group 26' and that ejects a relatively small amount of ink is combined with a ejection port array that is formed at a position close to the center of another nozzle group and that ejects a relatively small amount of ink to thereby form ejection port array. Furthermore, the ejection port array that is formed at the outer side of one nozzle group 26' and that ejects a relatively large amount of ink is combined with a ejection port array that is formed at the outer side of another nozzle group and that ejects a relatively large amount of ink to thereby form ejection port array.

Third Embodiment

Figure 11:
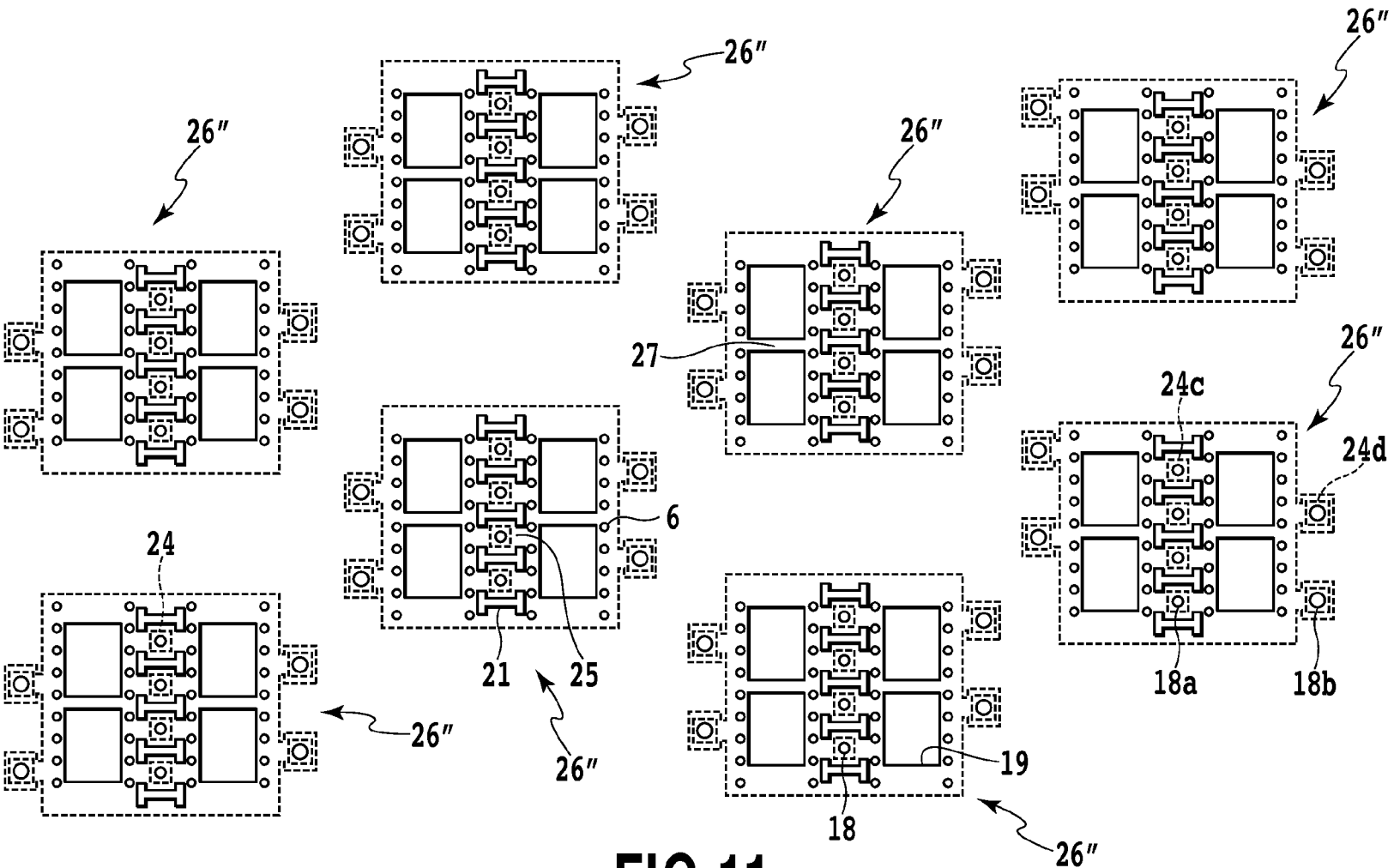
FIG. 11 is a top view illustrating eight nozzle groups of a print head according to the third embodiment of the present invention.

Next, with reference to FIG. 11, the third embodiment will be described. In FIG. 11, the same components as those of the first embodiment to the second embodiment are denoted with the similar reference numerals and will not be described further and only different parts will be described.

FIG. 11 is a top view illustrating the print head 10" of the third embodiment. In the print head of the second embodiment, two ejection port arrays having a relatively small ejection amount are formed at a position close to the center of the nozzle group and ejection port arrays having a relatively large ejection amount are formed at the outer sides of the nozzle group. The print head of the second embodiment is formed so that an interval between the ejection ports that are formed at a position close to the center of the nozzle group in the direction along which the ejection port arrays extend is equal to an interval between the ejection ports that are formed at the outer sides of the nozzle group in the direction along which the ejection port arrays extend.

On the other hand, the print head 10" of the third embodiment is structured so that one ejection port array both sides of which face the ink supply port 19 is formed at the center of one unit of nozzle group 26". Ejection port arrays each of which faces the ink supply port 19 only at one side thereof are formed at both outer sides of a direction orthogonal to the direction along which the ejection port arrays extend in nozzle group 26". Furthermore, the interval between the ejection ports formed at a position close to the center of the nozzle group 26" in the direction along which the ejection port arrays extend is formed to be a half of the interval between the ejection ports formed at the outer sides of the nozzle group 26" in the direction along which the ejection port arrays extend. This can consequently maintain the temperature of the print head evenly between the ejection port formed at a position close to the center of the nozzle group 26" and the ejection port formed at the outer side of the nozzle group 26". Even when these ejection port having different ejection amounts have a further-increased difference in the heat value among the heat generating elements corresponding to the respective ejection ports, the heat dissipation amounts can be balanced. In this embodiment, an interval between the ejection ports in the ejection port array formed by ejection ports facing the ink supply port 19 only in one direction in the direction along which the ejection port array extend is larger than an interval between ejection ports in the ejection port array formed by ejection ports sandwiched between the ink supply ports 19. As described above, an interval between ejection ports formed at the outer side of the nozzle group in the direction along which the ejection port array extends may be determined depending on a difference in heat value from a heat generating element between the ejection port formed at a position close to the center of the nozzle group 26" and the ejection port formed at the outer side of the nozzle group 26".

As a result, even when there is a relatively large difference in heat value from the heat generating element 24 between the ejection port 18*a* formed at a position close to the center of the nozzle group and the ejection port 18*b* formed at the outer side of the nozzle group 26", an even temperature distribution of the respective regions of the print head can be maintained. This can consequently suppress a case where the ejected inks have different ink characteristics depending on the respective regions. This can consequently maintain the quality of the image obtained through printing to be high.

In this embodiment, the four arrays of nozzle groups 26" are formed in a direction orthogonal to the direction along which the ejection port arrays extend. As described above, the number of arrays of the nozzle groups arranged on one element substrate 17 in a direction orthogonal to the direction along which the ejection port array extends is not limited to 2 and may be 4 as in this embodiment or also may be other numbers.

Fourth Embodiment

Figure 12:
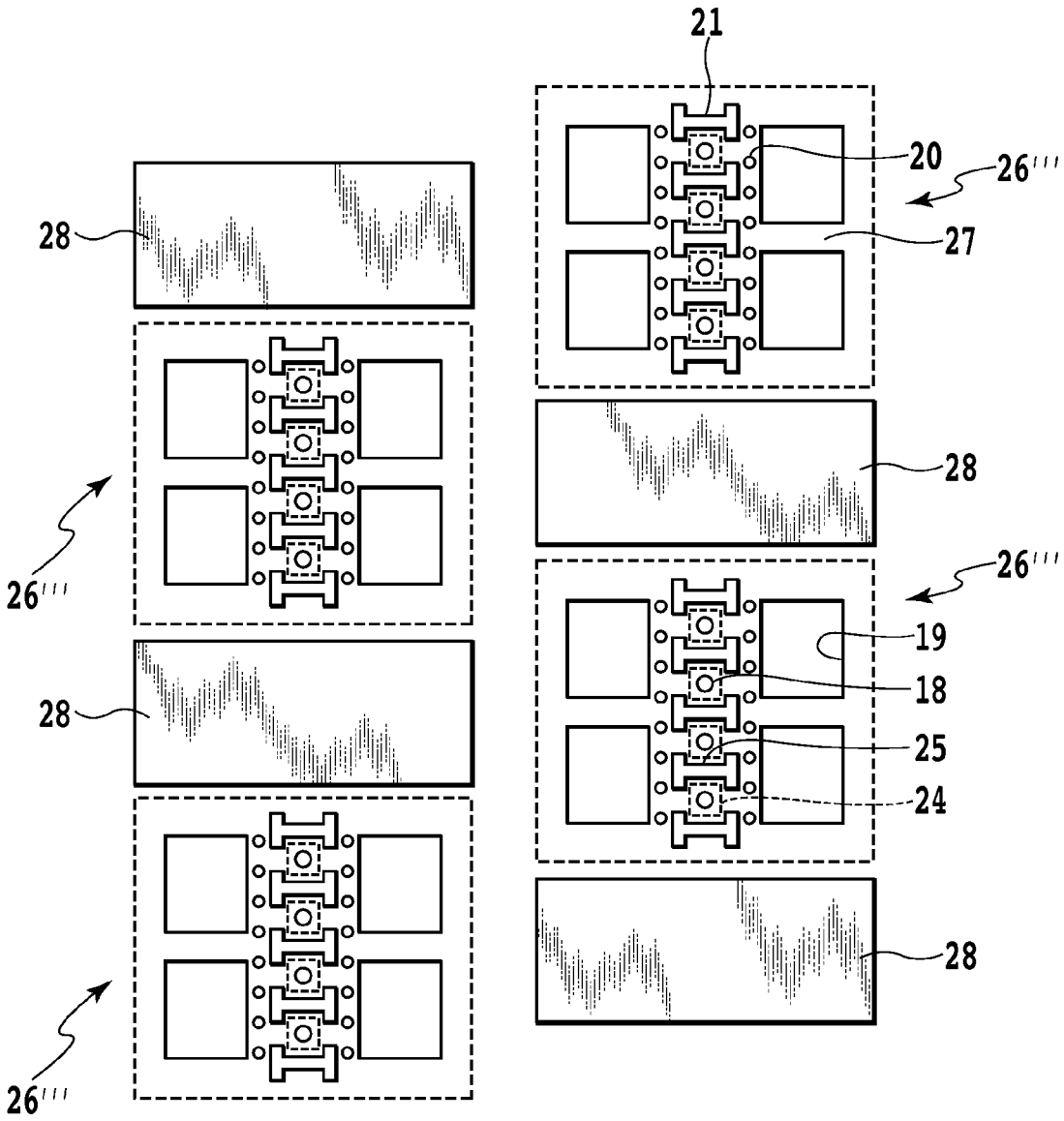
FIG. 12 is a top view illustrating four nozzle groups of a print head according to the fourth embodiment of the present invention.

Next, with reference to FIG. 12, the fourth embodiment of the print head 10''' will be described. In FIG. 12, the same components as those of the first embodiment to the third embodiment are denoted with the similar reference numerals and will not be described further and only different parts will be described.

FIG. 12 is a top view illustrating the print head of the fourth embodiment. In the print head of the first embodiment, one unit of nozzle group 26 includes one ejection port array and one array of heat generating element arrays corresponding to the ejection port array and the ink supply ports 19 formed at both sides of the ejection port array so as to sandwich the ejection port array. The ink supply port 19 is divided to four parts and the beam 27 is formed in a space between the ink supply ports 19 in the direction along which the ejection port array extends. The pressure chamber 25 is formed between the ink supply ports 19 in a direction orthogonal to the direction along which the ejection port array extends. The pressure chamber 25 receives ink supplied from the ink supply ports 19 formed at both sides thereof. These nozzle groups 26 are formed in two arrays that are arranged to be offset from each other in the direction along which the ejection port array extends.

In the print head 10''' of the fourth embodiment, a driver 28 for driving the heat generating element is further provided that is provided in a space between the nozzle groups 26''' formed by arranging the nozzle groups 26''' to be offset from each other. In this embodiment, the driver 28 is provided to be adjacent to the nozzle group 26''' including the heat generating element 24 driven by the driver 28. The driver 28 and the nozzle group 26''' are alternately provided in a direction along which the nozzle group array extends. As a result, the space formed by the offset arrangement of the nozzle groups 26''' can be used as the space to set the driver 28. Thus, the print head 10''' can have a size proportionally reduced in accordance with the reduced space in which the driver 28 is provided. Thus, the print head 10''' can have a smaller volume and the cost for manufacturing the print head 10''' can be reduced. As described above, in this embodiment, the driver 28 for driving the heat generating element 24 is provided in a space between a plurality of nozzle groups in the element substrate 17 that are formed to be offset from one another in the direction along which the nozzle group arrays extend.

Fifth Embodiment

Figure 13:
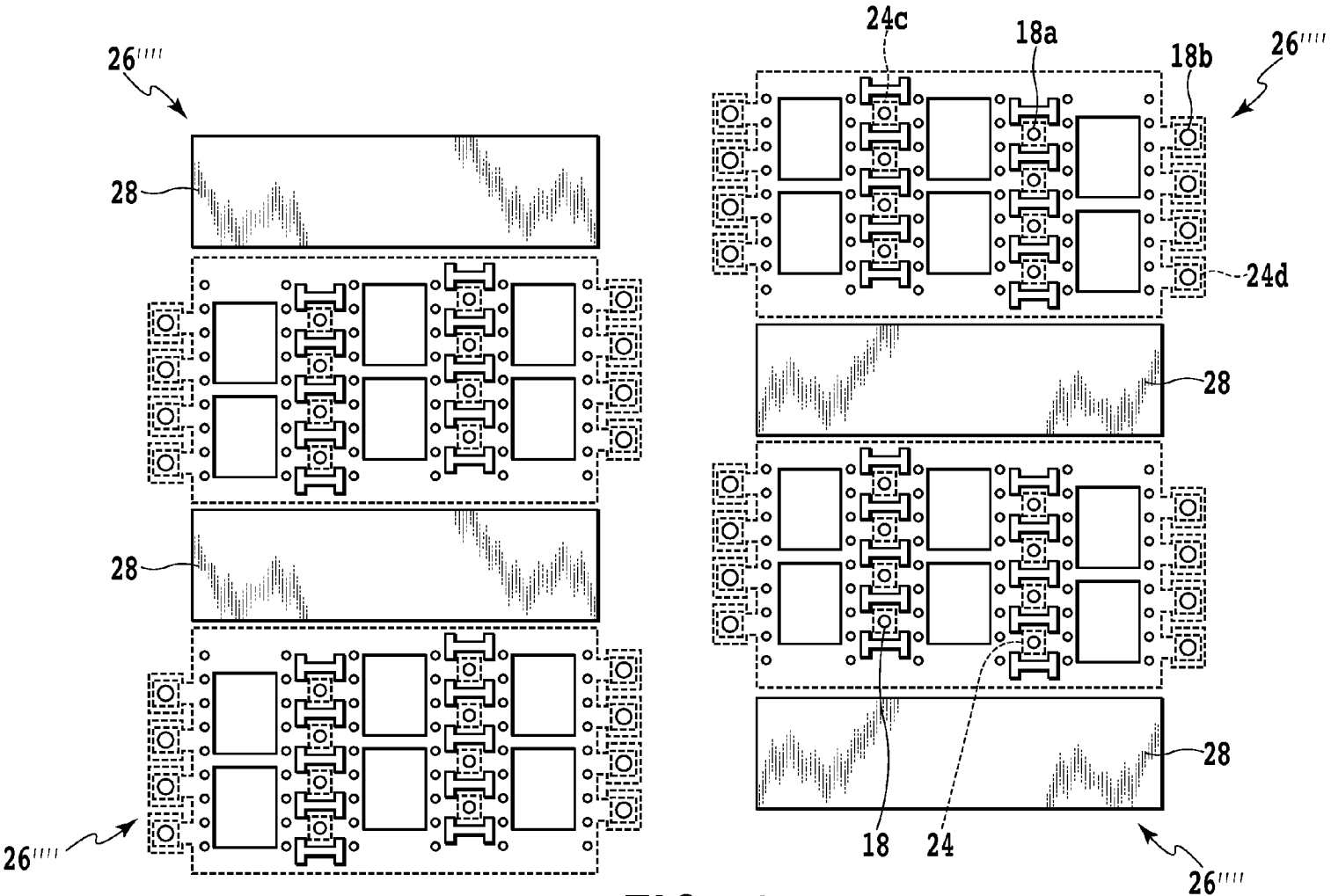
FIG. 13 is a top view illustrating four nozzle groups of a print head according to the fifth embodiment of the present invention.

Next, with reference to FIG. 13, the fifth embodiment will be described. In FIG. 13, the same components as those of the first embodiment to the fourth embodiment are denoted with the similar reference numerals and will not be described further and only different parts will be described.

FIG. 13 is a top view illustrating the print head 10'''' in the ink jet printing apparatus of the fifth embodiment. In the print head of the second embodiment, two ejection port arrays are arranged at a position close to the center of one unit of nozzle group and two arrays of the heat generating elements 24 are arranged at positions corresponding to the ejection ports 18 of the ejection port arrays. Furthermore, at each of both outer sides of the unit of nozzle group in a direction orthogonal to the direction along which the ejection port arrays extend, one ejection port array is further arranged. Furthermore, the ink supply ports 19 are formed between the two ejection port arrays close to the center and at both sides of each of the ejection port arrays. Thus, the one unit of nozzle group has three arrays of the ink supply ports 19.

Furthermore, in the print head 10'''' of the fifth embodiment, the drivers 28 for driving heat generating elements are arranged in spaces among nozzle groups formed by arranging the nozzle group 26'''' to be offset from one another. As a result, a space obtained by arranging the nozzle groups 26'''' to be offset from one another can be used as a space for arranging the driver 28. Thus, the print head 10'''' can have a size proportionally reduced in accordance with the reduced space in which the driver 28 is arranged.

Sixth Embodiment

Figure 14:
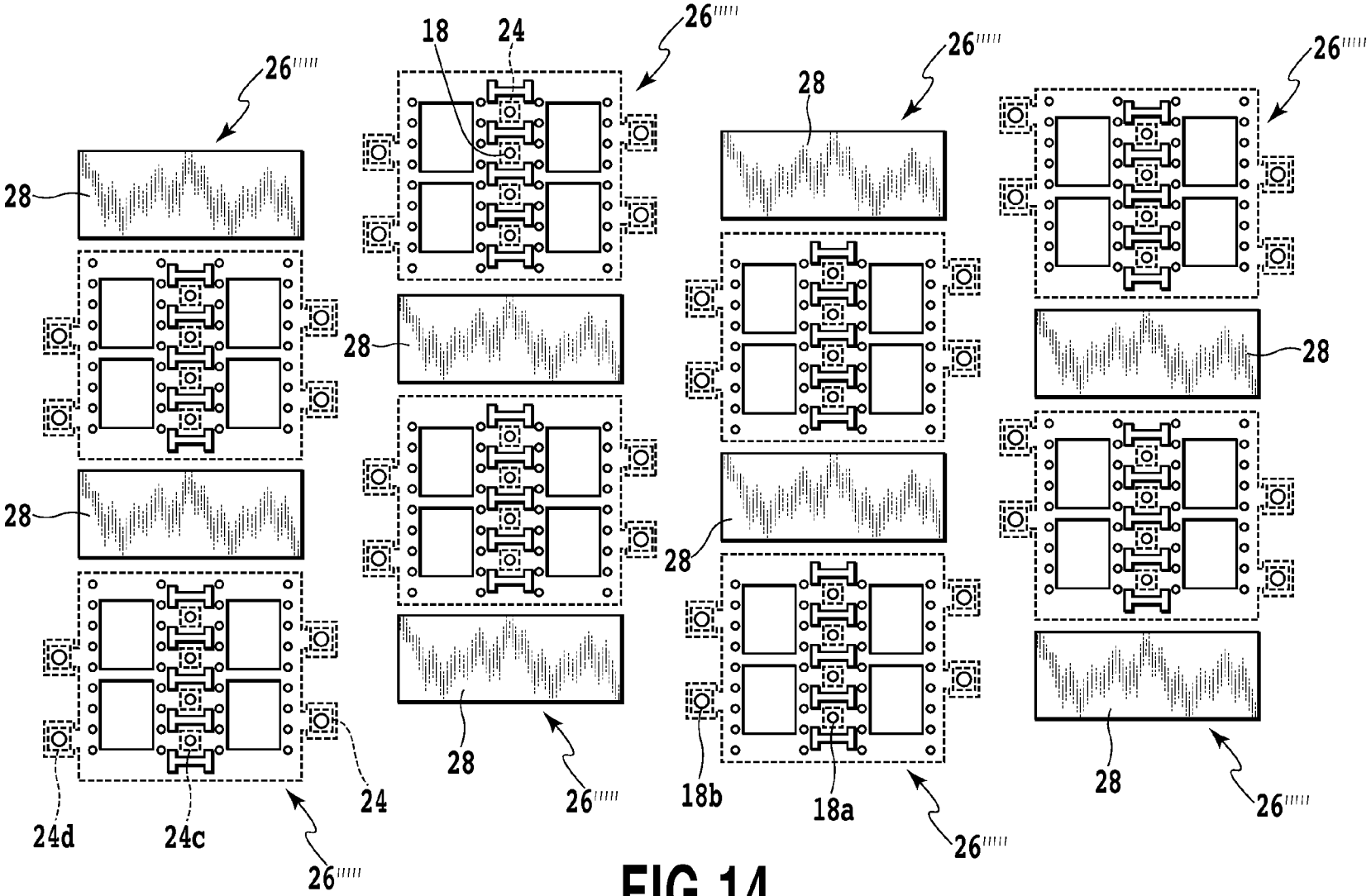
FIG. 14 is a top view illustrating eight nozzle groups of a print head according to the sixth embodiment of the present invention.

Next, the sixth embodiment will be described with reference to FIG. 14. In FIG. 14, the same components as those of the first embodiment to the fifth embodiment are denoted with the similar reference numerals and will not be described further and only different parts will be described.

FIG. 14 is a top view illustrating the print head 10''''' of the fifth embodiment. In the print head of the third embodiment, one ejection port array where both sides face the ink supply ports 19 is formed at the center of one unit of nozzle group. Ejection port arrays where only one side face the ink supply port 19 are formed at both outer sides of the one unit of nozzle group. Furthermore, an interval between the ejection ports 18 formed at the position close to the center of the nozzle group in the direction along which the ejection port array extends is formed to be a half of an interval between the ejection ports 18 formed at the outer sides of the nozzle group in the direction along which the ejection port array extends.

In the print head 10'''' of the sixth embodiment, the drivers 28 for driving heat generating elements is arranged at a space formed between the nozzle groups 26'''' and formed by arranging the nozzle groups 26''''. As a result, the space formed by arranging the nozzle groups 26'''' to be offset from one another can be used as a space for arranging the driver 28. Thus, the print head 10'''' can have a size proportionally reduced in accordance with the reduced space in which the driver 28 is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-026478, filed Feb. 6, 2009, which is hereby incorporated by reference herein in its entirety.

What is claimed is:

1. A liquid ejection head comprising:

an orifice plate including a plurality of ejection ports for ejecting liquid to a printing medium, a substrate including a plurality of heat generating elements for generating energy used to eject liquid, a plurality of liquid supply ports, which are through holes, for supplying liquid to the heat generating elements, and a beam formed between the liquid supply ports, and a plurality of nozzle groups, each of which is formed as one unit by combining a plurality of liquid chambers that communicate with the liquid supply ports and that are formed between the orifice plate and the substrate, and pressure chambers that are formed in the liquid chambers, each of which has a communication port communicating with a liquid supply port, each nozzle group including heat generating elements, liquid supply ports, and ejection ports, wherein a nozzle group includes the pressure chambers arranged therein in a row, wherein the plurality of nozzle groups are arranged in the substrate along the direction along which the pressure chambers are arranged to thereby form a plurality of nozzle group arrays, and wherein in the nozzle group arrays adjacent to one another, the plurality of nozzle groups forming the nozzle group arrays are formed to be offset from one another in the direction along which the pressure chambers are arranged.

2. The liquid ejection head according to claim 1, wherein a nozzle group has an ejection port sandwiched between the liquid supply ports when the orifice plate and the substrate are seen from the printing medium-side.

3. The liquid ejection head according to claim 2, wherein a nozzle group further has an ejection port facing a liquid supply port in only one direction when the orifice plate and the substrate are seen from the printing medium-side.

4. The liquid ejection head according to claim 3, wherein the ejection port facing the liquid supply port in only one direction has a higher liquid ejection amount than that from the ejection port formed to be sandwiched between the liquid supply ports.

5. The liquid ejection head according to claim 4, wherein a plurality of the ejection ports each of which is formed to be sandwiched between the liquid supply ports and a plurality of the ejection ports each of which faces the liquid supply port only in one direction are arranged in a plurality of arrays in the nozzle group to thereby form ejection port arrays, and, an interval between the ejection ports of the ejection port arrays formed by the ejection ports each of which is sandwiched between the liquid supply ports in the direction along which the ejection port arrays are arranged is equal to an interval between the ejection ports of the ejection port arrays formed by ejection ports each of which faces the liquid supply port only in one direction.

6. The liquid ejection head according to claim 4, wherein a plurality of the ejection ports each of which is formed to be sandwiched between the liquid supply ports and a plurality of the ejection ports each of which faces the liquid supply port only in one direction are arranged in a plurality of arrays in the nozzle group to thereby form ejection port arrays, and, an interval between the ejection ports of the ejection port array formed by the ejection ports each of which faces the liquid supply port only in one direction in the direction along which the ejection port arrays are arranged is larger than an interval between the ejection ports of the ejection port array formed by the ejection ports each of which is sandwiched between the liquid supply ports in the direction along which the ejection port arrays are arranged.

7. The liquid ejection head according to claim 1, wherein a plurality of ejection ports ejecting the same amount of liquid are arranged in a row in each of the nozzle groups to form ejection port array, the nozzle groups are arranged in a row to form nozzle group array, and in the same nozzle group array, ejection port arrays formed in different nozzle groups and having the same ejection amount are combined to thereby form a ejection port array.

8. The liquid ejection head according to claim 1, wherein a driver for driving the printing element is arranged between the nozzle groups that are adjacent to one another in the direction along which the pressure chambers are arranged in the substrate.

9. The liquid ejection head according to claim 8, wherein the driver is arranged to be adjacent to a nozzle group including the printing element driven by the driver, and the driver and the nozzle group are alternately arranged in the direction along which the pressure chambers are arranged.

10. The liquid ejection head according to claim 1, wherein liquid that is supplied by the liquid supply port to the printing element and that is ejected to a printing medium through a ejection port is ink and ink supplied to the same nozzle group is ink of the same color.

11. A liquid ejection head comprising:

an orifice plate including an ejection port array in which ejection ports for ejecting liquid are arranged in row in a first direction;

a substrate including a heat generating element array in which heat generating elements, formed at position corresponding to the ejection ports, for generating energy used to eject liquid are arranged in row in the first direction;

a liquid supply port array in which liquid supply ports, which are through holes, for supplying liquid to the heat generating elements are arranged in row in the first direction;

a beam formed at between plurality of the liquid supply ports;

a nozzle group array in which a plurality of nozzle groups, each of which is formed as one unit by combining the ejection port array, the heat generating element array, the liquid supply port array and the beam, are arranged in row in the first direction in a staggered manner.

12. The liquid ejection head according to claim 11, wherein the plurality of nozzle groups are formed at a position in which each of the nozzle groups are not overlapped regarding the first direction.

13. The liquid ejection head according to claim 11, wherein the heat generating element array is arranged at between the plurality of liquid supply port arrays in the nozzle group.

* * * * *